US005212869A

United States Patent [19]

Zacharchuk

[11] Patent Number: 5,212,869

[45] Date of Patent: May 25, 1993

[54] PAINT CAN RIM PERFORATING TOOL AND PAINT CAN PERFORATED THEREBY

[76] Inventor: Walter Zacharchuk, 28 B Bayshore Drive, Nepean, Ontario, Canada, K2B 6M8

[21] Appl. No.: 887,896

[22] Filed: May 26, 1992

[51] Int. Cl.[5] ..... B67B 7/46

[52] U.S. Cl. ..... 30/366; 30/446; 7/152; 81/3.55

[58] Field of Search ..... 30/366, 446, 443, 450; 7/105, 151, 152, 156; 81/3.09, 3.55

[56] References Cited

U.S. PATENT DOCUMENTS

| | | | |
|---|---|---|---|
| 1,696,920 | 1/1929 | Miller | 7/151 |
| 2,754,582 | 7/1956 | Klok | 81/3.55 |
| 2,861,337 | 11/1958 | Behlau | 7/152 |
| 3,055,106 | 9/1962 | Schneier | 30/446 |
| 4,492,132 | 1/1985 | Obey | 7/151 |
| 4,580,302 | 4/1986 | Barth | 30/366 |
| 4,631,769 | 12/1986 | White | 30/366 |

*Primary Examiner*—Frank T. Yost
*Assistant Examiner*—Hwei-Siu Payer
*Attorney, Agent, or Firm*—Stanley E. Johnson

[57] ABSTRACT

A pry type hand tool for making drain holes in the bottom wall of a lid receiving channel on the top rim of a paint can. The tool has a handle portion and a bifurcated end where the two legs are offset laterally and longitudinally. One leg has an inwardly turned end, directed toward the other leg, forming a shallow channel and the other leg has a sharpened tip and knife like cutting edge.

5 Claims, 2 Drawing Sheets

PAINT CAN RIM PERFORATING TOOL AND PAINT CAN PERFORATED THEREBY

FIELD OF INVENTION

This invention relates to a tool for making drain holes in the bottom of the lid receiving channel in the top rim of a paint can.

BACKGROUND OF INVENTION

Paint cans conventionally have a channel that matingly receives a rib on the lid. The lid is removable and the construction is such as to provide an air tight seal necessary to preserve the content of the container. During use the inner peripheral edge of the rim is used to scrape off excess paint from the paint brush with the result paint often gets into the channel. Also when pouring paint from the container some paint remains in the channel and it is well known to many as to what can happen when a paint can lid is tapped into place closing the container while there is still paint in the channel.

It is difficult to remove the paint from the channel and a common practice of painters is to drive a nail through the bottom of the channel at different locations so as to form drain holes whereby the liquid in the channel will drain back into the container or be forced into the container when the lid is put back on the paint pail. This is a hap hazard arrangement which often damages the rather delicately and integrally formed walls of the channel that provide an air tight seal with the rib on the lid.

SUMMARY OF THE INVENTION

An object of the present invention is to provide a tool that is readily operated by hand to form perforations in the bottom of the channel of a paint can rim without adversely affecting the seal the channel makes with the rib on the lid.

A further object of the present invention is to provide a tool whereby perforations of uniform size are formed in the channel and in the bottom of the channel below where the sidewalls normally form a sealing engagement with the rim on the lid.

In accordance with the present invention there is provided a pry type hand tool having a bifurcated end one arm of which is curved to nestingly receive therein a portion of the underside of the channel on the paint can rim and the other arm of which has a piercing end that fits into the channel and readily can be forced through the bottom wall of the channel to form a drain aperture.

LIST OF DRAWINGS

The invention is illustrated by way of example in the accompanying drawings wherein.

DESCRIPTION OF PREFERRED EMBODIMENTS

Figure 1:
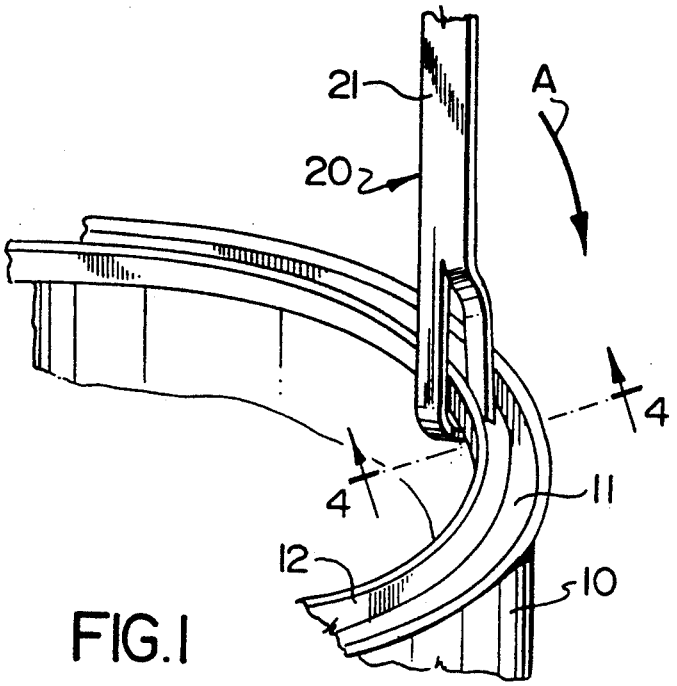
FIG. 1 is a partial oblique view illustrating the hand tool of the present invention in position for hand manipulation to form a drain hole in the bottom of the channel of the paint can rim.

Referring to the drawings in FIG. 1 there is partially illustrated the upper portion of a paint can 10 which has an upper rim 11 in which there is a U-shaped channel 12 for sealingly receiving a rib projecting downwardly from a lid (not shown) for the paint can. The channel is shown in cross section in FIG. 4 and is defined by an inner side wall 12A, an outer side wall 12B and a bottom wall or a bite portion 12C. Conventionally the walls 12A and 12B taper to clampingly receive therebetween the downwardly projecting rib on the lid.

In accordance with the present invention there is provided a tool 20 for forming an aperture or apertures in the bottom channel wall 12C so that paint that gets into the channel may drain back into the paint pail or be forced back into the pail when reclosing the container with the lid.

Figure 3:
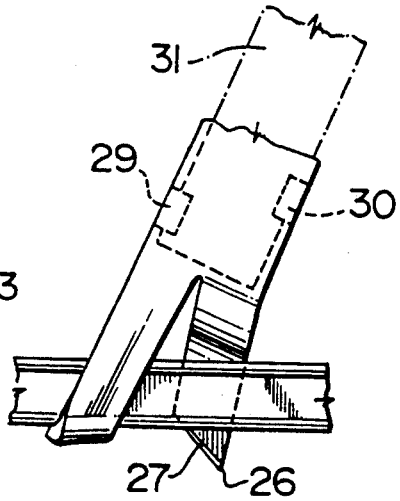
FIG. 3 is a view similar to FIG. 2 but showing the hand tool in a position after forming a perforation in the bottom of the channel.
Figure 4:
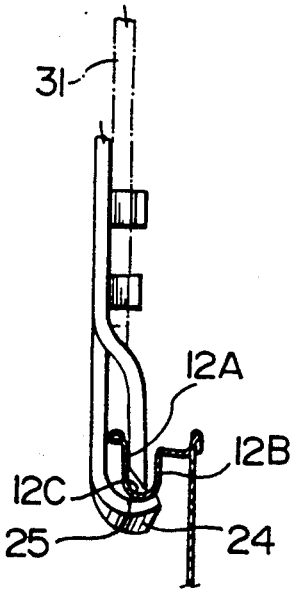
FIG. 4 is a part sectional view taken essentially along line 4—4 of FIG. 1.
Figure 5:
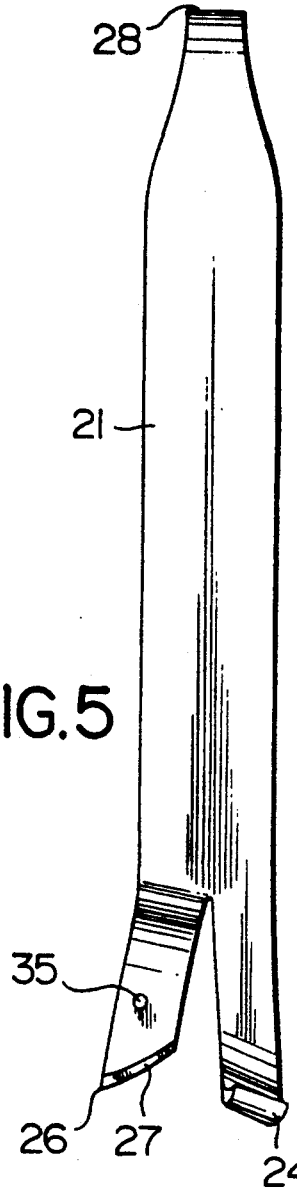
FIG. 5 is an elevational view of the tool incorporating a modification to limit the depth of penetration.
Figure 6:
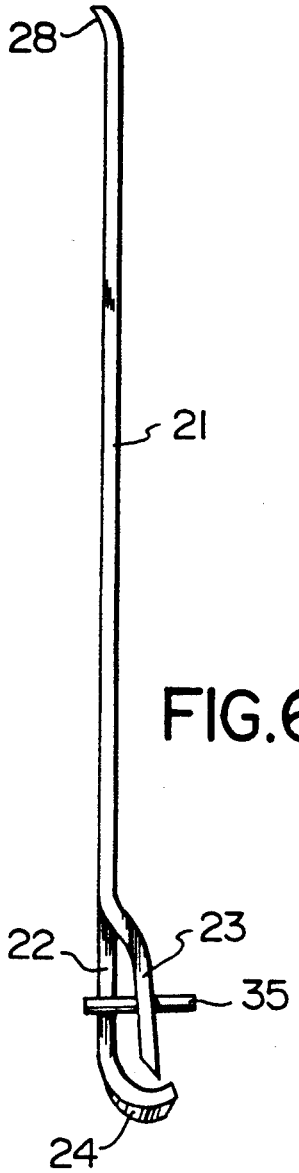
FIG. 6 is a right hand elevational view of FIG. 5.

The hand tool 20 has a handle portion 21 which may be integrally formed with the tool as shown in FIGS. 5 and 6 or it may be a stick, for example, a conventional paint stir stick detachably or slip fit there onto in any convenient manner for example as illustrated in FIGS. 3 and 4.

The tool has an operative end portion which is bifurcated providing respective leg portions 22 and 23 laterally offset from one another as shown in FIG. 4. Leg 22 terminates in an inwardly turned portion 24 providing a shallow channel 25 for matingly receiving a bottom part of the paint pail channel wall 12C. In this position, and as illustrated in FIG. 4, leg 23 is offset sufficiently from leg 22 so as to fit into the channel between channel walls 12A and 12B. Leg 23 is provided with a piercing end portion that has a sharpened tip 26 and sloping away therefrom a sharpened cutting edge portion 27.

The handle 21 may be integrally formed with the bifurcated end as clearly illustrated in FIGS. 5 and 6 terminating at the outer end in a bent end portion 28 for use in prying open the lid of the paint can. Alternatively and as illustrated in FIGS. 3 and 4 the bifurcated end portion may be provided with inwardly directed lugs designated 29 and 30 for receiving therebetween an end portion of a conventional wooden paint stir stick 31.

Figure 2:
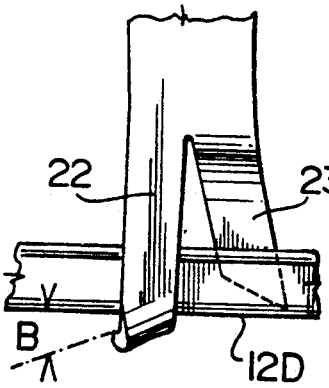
FIG. 2 is a partial side elevational view showing the position of the hand tool relative to the channel prior to forming a perforation in the bottom of the channel.

As illustrated in FIG. 1 the handle 21 is moved in the direction of arrow A to move the tool from the position illustrated in FIG. 2 to the position illustrated in FIG. 3 so as to cause formation of a hole in the bottom 12C of the channel. In the embodiment illustrated in FIG. 3 the lugs 29 and 30 are offset from one another in a direction lengthwise of the handle for appropriately transferring forces from the handle to the piercing tool during a piercing operation.

Figure 7:
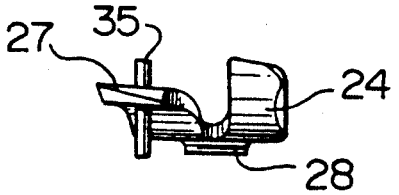
FIG. 7 is a bottom view of FIG. 5.

The inwardly turned end portion 24 of leg 22 is sloped at an angle designated B in FIG. 2 with reference to the bottom edge of the channel which it engages. As the piercing operation occurs this angle reduces and is zero when, as seen in FIG. 3, the piercing end of arm 23 has formed a hole in the bottom wall 12C of the channel. This angle B has the general purpose of forming a rolling contact during the piercing operation of the inwardly curved end 24 on the bottom of the paint can channel. Also it serves as a stop by being in effectively flat contact with the underside of the channel so that each perforation is approximately of the same size. A more positive form of stop can be provided one form of which is illustrated in FIGS. 5 to 7 wherein a pin 35 is press fit into an aperture in the leg 23. Pin 35 is so positioned as to engage the top of the paint pail limiting the degree of penetration of the piercing tip 26 and cutting edge 27 into the channel bottom wall 12C. In place of pin 35 any suitable stop means could be mounted on the arm 23 and adjustably movable therealong so as to enable varying, if desired, the depth of penetration of the piercing arm 23 into the channel bottom wall 12C.

The offset of the arms 22 and 23 is such that the bottom wall of the channel is pierced avoiding deformation of the side walls 12A and 12B and thus substantially avoiding any adverse effects on the sealing when the lid is replaced on the pail.

I claim:

1. A pry-type hand tool for making perforations in the bottom wall of a channel formed in the top rim of a paint can in which such channel is used for mounting a lid thereon, said tool comprising a handle and bifurcated end part at one end of said handle, said bifurcated end part including two legs laterally and longitudinally offset from one another, one of said legs having an inwardly turned end portion extending in a direction toward the other of said legs, said inwardly turned portion providing a shallow longitudinal channel for nestingly receiving therein an underside portion of the channel in said paint can rim, said other leg having a sharpened tip for piercing through said bottom wall of said channel and a sharpened longitudinal edge for cutting through such wall, said sharpened edge being generally aligned with the longitudinal direction of said shallow channel, said sharpened tip being located on said other leg at a position remote from said one leg, said shallow channel and longitudinal sharpened edge being spaced from one another and sloped relative to one another in opposite directions diverging outwardly from one another in a direction away from the handle, said sharpened piercing tip, shallow channel and longitudinal sharpened edge being disposed relative to one another such that said inwardly turned end, defining said shallow channel, initially engages the underside of the bottom wall of said channel of said paint can rim and at a position nearest said other leg when said sharpened piercing tip engages the bottom wall of said channel prior to piercing such wall.

2. A hand tool as defined in claim 1 wherein said handle is integrally formed with said bifurcated end.

3. A hand tool as defined in claim 1 wherein an end of said handle opposite said bifurcated end part is bent forming a pry for removing the lid from a paint can.

4. A hand tool as defined in claim 1 wherein said handle is detachable from said bifurcated end part.

5. A hand tool as defined in claim 4 wherein said bifurcated end part has inwardly directed spaced apart lugs slidingly receiving therebetween an end portion of a paint stir stick which provides said handle.

* * * * *